US011049681B1

(12) United States Patent
Chennakesavelu et al.

(10) Patent No.: US 11,049,681 B1
(45) Date of Patent: Jun. 29, 2021

(54) PROTECTION DEVICE WITH U-SHAPED FUSE ELEMENT

(71) Applicant: Littelfuse, Inc., Chicago, IL (US)

(72) Inventors: Ganesh Nagaraj Chennakesavelu, Lombard, IL (US); Engelbert Hetzmannseder, Chicago, IL (US); Derek Lasini, Schaumburg, IL (US)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 16/838,521

(22) Filed: Apr. 2, 2020

(51) Int. Cl.

| | |
|---|---|
| ***H01H 85/08*** | (2006.01) |
| ***H01H 85/38*** | (2006.01) |
| ***H01H 85/175*** | (2006.01) |
| *H01H 85/18* | (2006.01) |

(52) U.S. Cl.
CPC ..... *H01H 85/08* (2013.01); *H01H 85/175* (2013.01); *H01H 85/38* (2013.01); *H01H 85/18* (2013.01)

(58) Field of Classification Search
CPC ..... H01H 85/08; H01H 85/175; H01H 85/18; H01H 85/38; H01H 2085/383; H01H 2085/388
See application file for complete search history.

(56) References Cited

U.S. PATENT DOCUMENTS

| | | | | |
|---|---|---|---|---|
| 2,734,110 | A * | 2/1956 | Jacobs | H01H 85/38 337/281 |
| 4,071,837 | A * | 1/1978 | Ranzanigo | H01H 85/165 337/268 |
| 4,894,633 | A * | 1/1990 | Holtfreter | H01H 85/0411 337/201 |
| 5,101,187 | A * | 3/1992 | Yuza | H01H 85/0417 337/278 |
| 5,572,181 | A * | 11/1996 | Kiryu | H01H 85/0411 337/273 |
| 5,793,275 | A * | 8/1998 | Iversen | H01H 85/055 337/273 |
| 6,873,243 | B1 * | 3/2005 | Karnes | H01H 85/0411 337/273 |
| 2003/0089962 | A1 * | 5/2003 | Anderson | H01L 23/5256 257/529 |
| 2016/0155596 | A1 * | 6/2016 | Ziegler | H01H 85/38 337/281 |
| 2020/0135422 | A1 * | 4/2020 | Hong | H01H 37/761 |

* cited by examiner

*Primary Examiner* — Jacob R Crum
(74) *Attorney, Agent, or Firm* — Kacvinsky Daisak Bluni PLLC

(57) ABSTRACT

Provided herein are protection devices having U-shaped fuse elements. In some embodiments, a protection device may include a housing defining a cavity, and a fuse element within the cavity. The fuse element may include a first component and a second component separated by a barrier, and wherein the first and second components are joined at a fusible bridge.

16 Claims, 6 Drawing Sheets

PROTECTION DEVICE WITH U-SHAPED FUSE ELEMENT

FIELD OF THE DISCLOSURE

The disclosure relates generally to circuit protection devices, more particularly, to a protection device with a U-shaped fuse element.

BACKGROUND OF THE DISCLOSURE

Fuses are commonly used as circuit protection devices. Fuses can provide electrical connections between sources of electrical power and circuit components to be protected. High-voltage, current-limiting fuses are used in a variety of applications including, for example, Electric Vehicles (EVs) and Hybrid-Electric Vehicles (HEVs). EV systems typically use much higher voltages and currents than non-EV automotive systems. Bus voltages for EV systems can be in the range of 600 volts DC or AC, and currents can be in the range of 300 amps. These high-voltage applications therefore require fuses capable of handling the increased energy and arcing associated with an opening of a fuse element within the fuse used for such applications.

Capable EV fuse products currently existing have limited mounting and wiring options. The assortment of shapes of overcurrent protection equipment and difficulties in wiring tends to result in inefficient use of space in limited areas. As space becomes a premium in a competitive EV industry, a more efficient overcurrent protection device is desired.

SUMMARY

This Summary is provided to introduce a selection of concepts in a simplified form that are further described below in the Detailed Description. This Summary is not intended to necessarily identify key features or essential features of the claimed subject matter, nor is it intended as an aid in determining the scope of the claimed subject matter.

In some embodiments, a protection device may include a housing defining a cavity, and a fuse element within the cavity. The fuse element may include a first component and a second component separated by a barrier, and wherein the first and second components are joined at a bridge.

In some embodiments, a fuse assembly may include a housing defining a cavity, and a fuse element within the cavity, wherein the fuse element includes a first component extending parallel to a second component, wherein the first and second components are joined at a bridge, and wherein the first and second components are separated by a barrier.

In some embodiments, a protection device may include a housing defining a cavity, and a fuse element within the cavity, wherein the fuse element includes a first component and a second component separated by a barrier and joined at a fusible bridge, and wherein the fuse element has an inverted U-shape.

Figure 1:
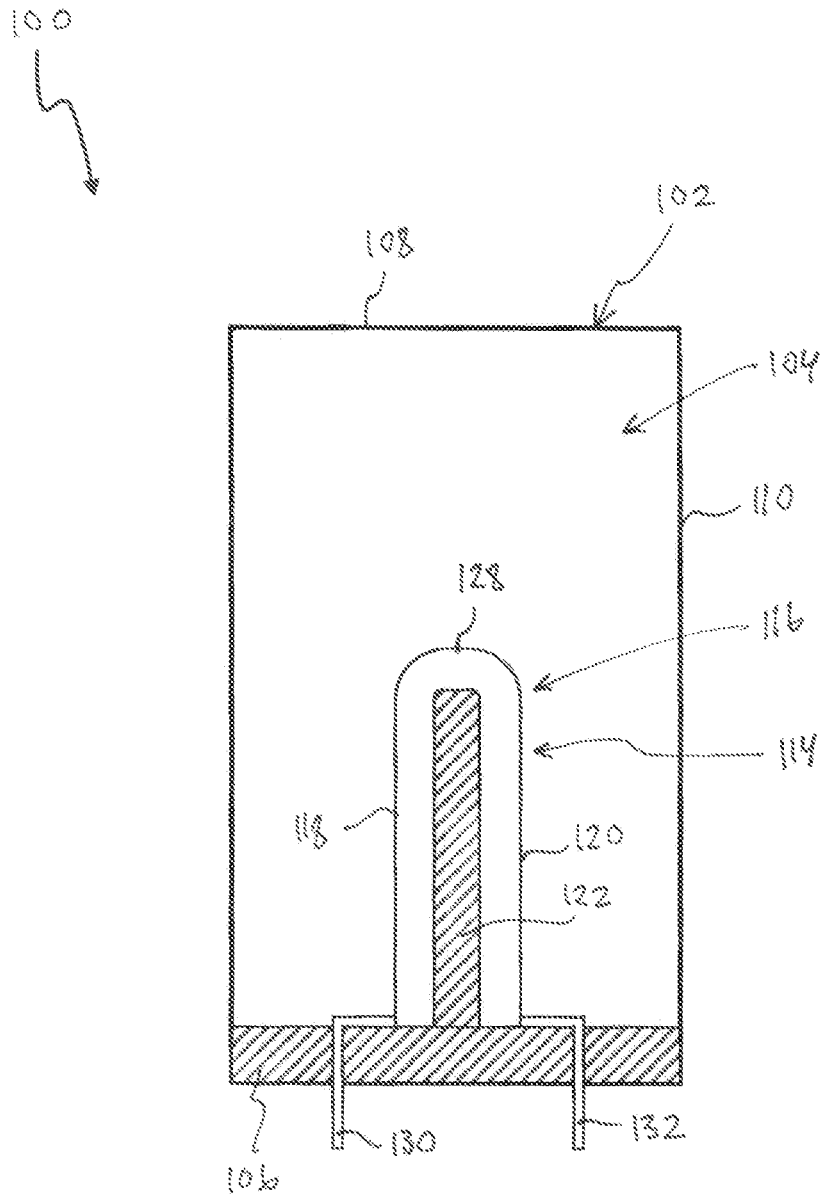
FIG. 1 is a side cross-sectional view illustrating a protection device according to exemplary embodiments.

The drawings are not necessarily to scale. The drawings are merely representations, not intended to portray specific parameters of the disclosure. The drawings are intended to depict typical embodiments of the disclosure, and therefore should not be considered as limiting in scope. In the drawings, like numbering represents like elements.

Furthermore, certain elements in some of the figures may be omitted, or illustrated not-to-scale, for illustrative clarity. Cross-sectional views may be in the form of "slices", or "near-sighted" cross-sectional views, omitting certain background lines otherwise visible in a "true" cross-sectional view, for illustrative clarity. Furthermore, for clarity, some reference numbers may be omitted in certain drawings.

DETAILED DESCRIPTION

Fuse apparatuses and assemblies in accordance with the present disclosure will now be described more fully hereinafter with reference to the accompanying drawings, in which embodiments of the system and method are shown. The fuse apparatuses and assemblies, however, may be embodied in many different forms and should not be construed as being limited to the embodiments set forth herein. Rather, these embodiments are provided so that this disclosure will be thorough and complete, and will fully convey the scope of the system and method to those skilled in the art.

As mentioned above, EV fuses are a relatively new type of fuse to the automotive market within the last decade or so. Historically, these fuses have roots in industrial fuse design and have been slowly progressing to a more automotive-friendly design as volumes ramp up. The industrial design is typically very limiting in attachment into the application, overall fuse construction/appearance, and robustness. This disclosure provides a more automotive-friendly design, e.g., in shape/construction, performance, and features.

Although non-limiting, embodiments of the present disclosure may be applicable to fuses operating at a minimum of 500 VDC and including, or even surpassing, 1000 VDC. Current range may be even more broad, but typically includes ratings from 100 A to 500 A.

In some embodiments, the overall construction of the fuse element takes on an inverted u-shape. During an arc event, when there is an abrupt change in magnitude of current flow, the arc is forced outward and away from the two current paths of the u-shaped element due to electromagnetic forces (B-forces). Advantageously, by forcing the arc outward, the arc is lengthened and pushed away from metal of the fuse, which would otherwise feed the arc and, thus, more likely to be extinguished quickly.

The disclosure also considers the fact that the closer together the current paths are, the higher this B-force is. As such, embodiments herein may provide a barrier to separate the two paths the u-shaped element and provide insulation and additional arc suppression. Utilizing a highly endothermic material, e.g., melamine or Polyamide 46 (PA46), can also help extinguish the arc due to the close proximity and outgassing or endothermic effects. Utilizing this material in other areas of the fuse construction (e.g., entire body, etc.)

may also help improve the arcing performance of the fuse, possibly allowing for the elimination of sand from high voltage fuses.

An additional performance method for quenching the arc according to embodiments of the present disclosure is to use a varied volume arc chamber. For example, as the arc consumes the current paths of the fuse element, the B-force forces the arc into a larger volume area, which reduces the energy of the arc not only by lengthening it, but by reducing the pressure. This is especially advantageous when designing a high voltage fuse without a filler material (e.g., sand).

Furthermore, in some embodiments of the disclosure, splitter plates may be added to the device, wherein the arc can be cooled down by adding non-current-carrying mass to the arc path. Advantageously, this can improve the arcing performance with sand or potentially allow for elimination of the sand entirely. Still furthermore, in some embodiments, packaging options may also be varied. For example, plug-in terminals can be utilized due to the construction of the bottom fuse section. In other embodiments, terminals can be formed and stamped with a hole for bolt-down applications. In still other embodiments, the terminals can be formed along the sides of the fuse body to work with soldered PCB applications or clamp-type connections. Similar to 0HEV/10EV, this type of construction can accept custom terminals that can be soldered to terminal stubs.

Still furthermore, another aspect of this disclosure is the addition of armor to enclose the fuse. Wrapping the high arc quenching material in a stronger material may allow more strength, thus keeping pressure inside of the fuse from escaping. This advantageously allows for a smaller footprint and reduces the use of arc-quenching material, which may be expensive.

Referring to FIG. 1, an exemplary embodiment of a fuse apparatus/assembly/device (hereinafter, "device") 100 in accordance with the present disclosure is shown. The exemplary device 100 may include a housing 102 defining an internal cavity 104. Although not limited to any particular shape or configuration, the housing 102 may include a base wall 106, a top wall 108, and a set of sidewalls 110. In some embodiments, the various components of the housing 102 may be made of an insulating material, such as an insulating plastic, e.g., nylon, glass-filled nylon, polyester and polycarbonate. In various embodiments, the base wall 106, the top wall 108, and the sidewalls 110 can be made of the same or different materials.

The cavity 104 may include one or more circuit protection devices, e.g., fuses 114, disposed therein. The fuse 114 may include a fuse element 116 within the cavity 104, the fuse element 116 being formed from or comprised of any material having desirable electrically conductive properties. In certain embodiments, the fuse element 116 can be nickel, copper, tin, or an alloy or mixture comprising nickel, copper, silver, gold, or tin, or any combination thereof. In certain embodiments, the fuse element 116 may have an approximate thickness of between 5 and 20 mils (a mil being a thousandth of an inch).

The fuse element 116 may include a first component 118 and a second component 120 separated by a barrier 122. Although non-limiting, the first and second components 118, 120 generally extend parallel to one another, forming an inverted U-shape. The first and second components 118, 120 may be joined at a bridge 128. In some embodiments, the bridge 128 may include one or more weakened or thinned segments separated by perforations to form a set of fusible links. During an overcurrent event, the fusible links fail to prevent current from passing between the first and second components 118, 120. In some embodiments, the first and second components 118, 120 extend parallel to corresponding exterior surfaces of the barrier 122. In some embodiments, the first and second components 118, 120 may be in direct contact with the barrier 122. Said another way, the fuse element 116 may wrap around the barrier 122.

As further shown, a first terminal 130 may be connected to the first component 118 and a second terminal 132 may be connected to the second component 120. In this embodiment, the first and second terminals 130, 132 extend outside of the housing 102, through the base wall 106. As illustrated, the free ends of the first and second terminals 130, 132 may be formed as blades for connection as a plug-in fuse to the other electrical components.

In some embodiments, the cavity 104 may be filled with an arc suppressant material, such as silica, silicone, sand, or any combination thereof. An opening through the housing 102 may allow the cavity 104 to be filled with the arc suppressant material. Although non-limiting, the hole may be centered in the top wall 108 so that the arc suppressant material may evenly fill the cavity 104.

As shown, the barrier 122 may extend between the first and second components 118, 120 of the fuse element 116. The barrier 122 and the first and second components 118, 120 may extend perpendicular to the base wall 106. In exemplary embodiments, the barrier 122 may be constructed from a high outgassing or endothermic materials. The barrier 122 and the base wall 106 may be the same material. During use, the barrier 122 is an arc barrier generally formed according to the shape of the fuse element 116.

Figure 2:
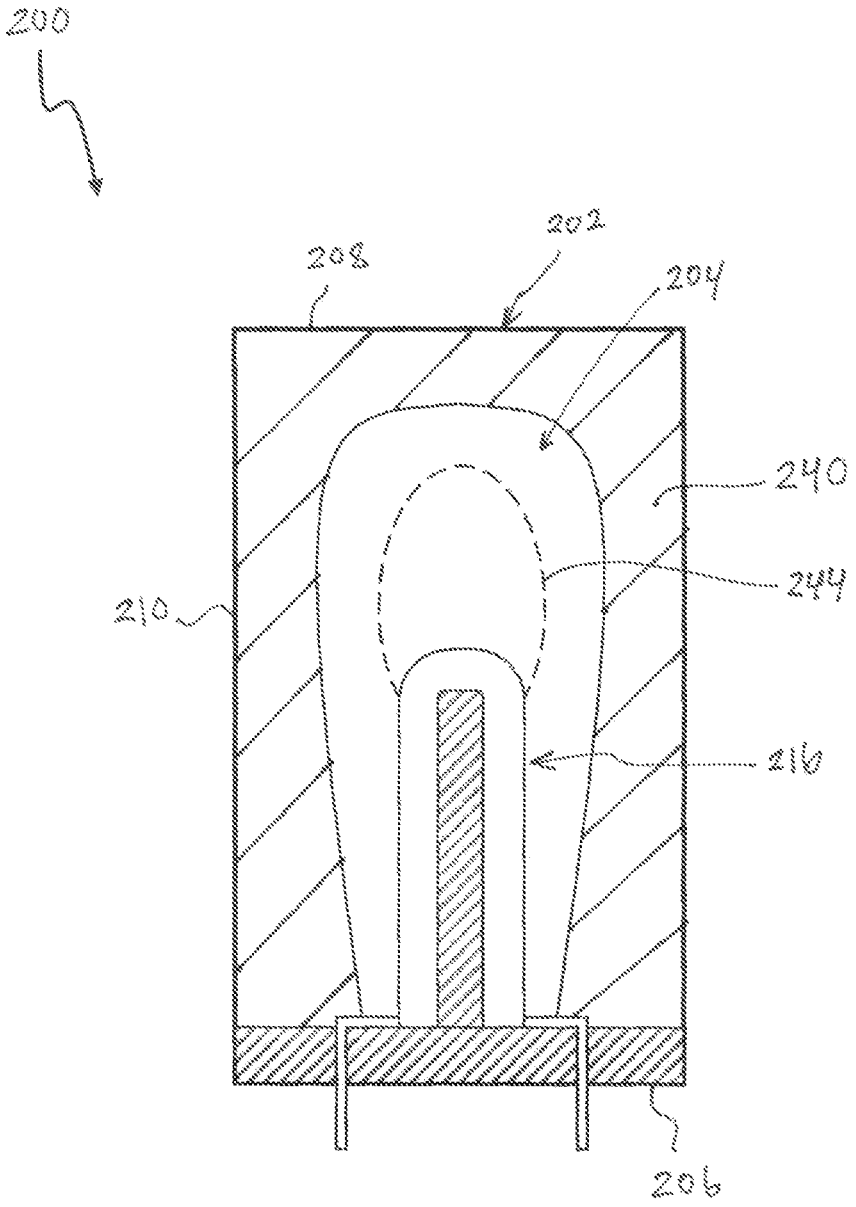
FIG. 2 is a side cross-sectional view illustrating a protection device according to exemplary embodiments.

Referring to FIG. 2, an exemplary embodiment of a fuse device (hereinafter, "device") 200 in accordance with the present disclosure is shown. The device 200 may be the same or similar in certain aspects to the device 100 described above. As such, only certain aspects of the device 200 may hereinafter be described for the sake of brevity. The exemplary device 200 may include a housing 202 defining an internal cavity 204. A u-shaped fuse element 216 may be disposed within the cavity 204. The housing 202 may include a base wall 206, a top wall 208, and a set of side walls 210.

The housing 202 may further include an armor layer 240 extending into the cavity. In some embodiments, the armor layer 240 may be formed along interior surfaces of the base wall 206, the top wall 208, and the side walls 210. In other embodiments, the armor layer 240 may additionally, or alternatively, be formed along one or more exterior surfaces of the housing 202. As shown, an interior surface 242 of the armor layer 240 may define the cavity 204. In this embodiment, the cavity 204 takes on an inverted teardrop shape or profile. The shape of the cavity 204 keeps an arc volume 244 generally equidistant from the interior surfaces of the housing 202 to provide enhanced cooling and outgassing. In some embodiments, the armor layer 240 may be a stainless steel. In some embodiments, the cavity 204 may be filled with an arc suppressant material, such as silica, or sand.

Figure 3:
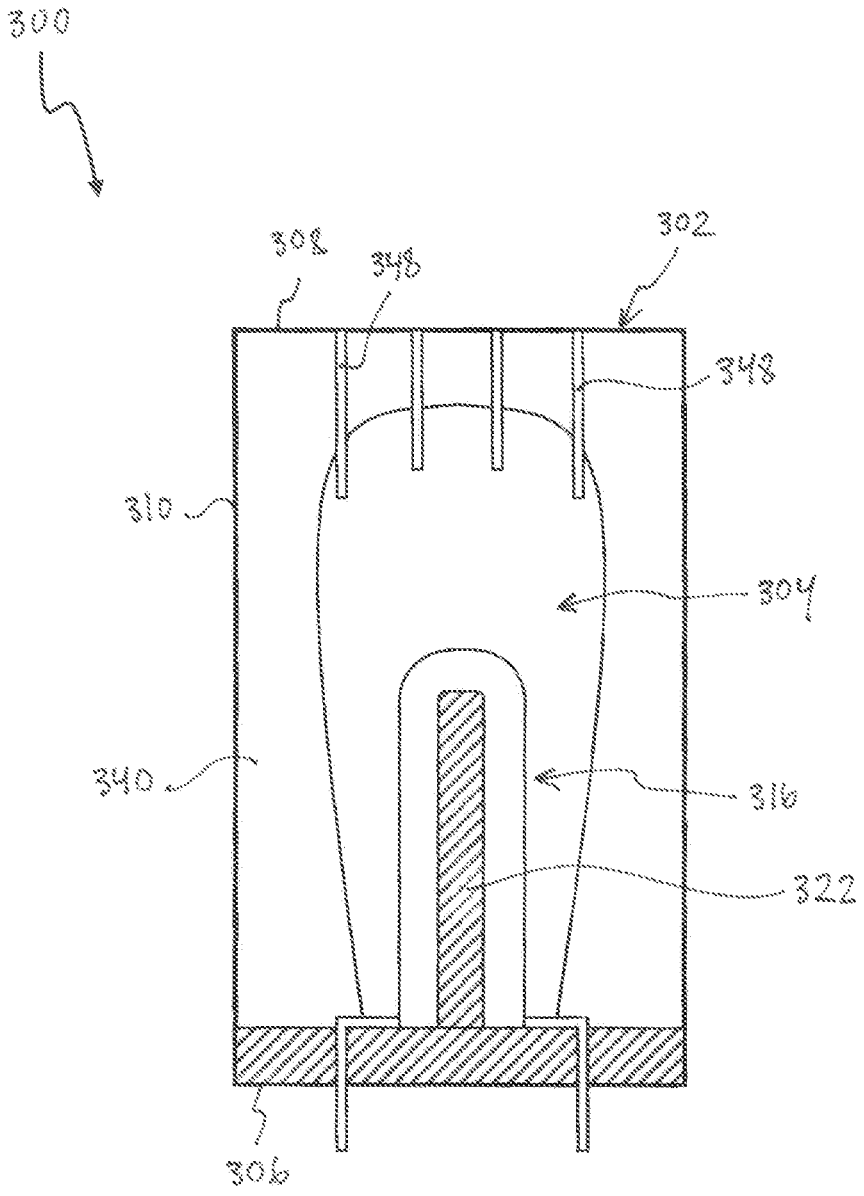
FIG. 3 is a side cross-sectional view illustrating a protection device according to exemplary embodiments.

Referring to FIG. 3, an exemplary embodiment of a fuse device (hereinafter, "device") 300 in accordance with the present disclosure is shown. The device 300 may be the same or similar in certain aspects to the devices 100 and 200 described above. As such, only certain aspects of the device 300 may hereinafter be described for the sake of brevity. The exemplary device 300 may include a housing 302 defining an internal cavity 304. A u-shaped fuse element 316 may be disposed within the cavity 304. The housing 302 may include a base wall 306, a top wall 308, and a set of side walls 310.

Extending into the cavity 304 may be a plurality of splitter plates 348. The splitter plates 348 may generally extend perpendicular to the top wall 308. During use, the splitter plates 348 split arcs into a series of smaller arcs of less voltage. The splitter plates 348 may be symmetrical on both sides of a centerline extending through a barrier 322. The splitter plates 348 can be made of any ferrous material, including, but not limited to, steel. More or fewer plates than shown can be used in other implementations. Furthermore, it will be appreciated that the size of splitter plates 348, and the spacing(s) between them, can be chosen depending on the particular implementation, such as based on the overall size of the device 300 and/or the voltage or current that is expected to occur.

In some embodiments, the housing 302 may further include an armor layer 340 formed along interior surfaces thereof. Furthermore, in some embodiments, the cavity 304 may be filled with an arc suppressant material, such as silica, or sand.

Figure 4:
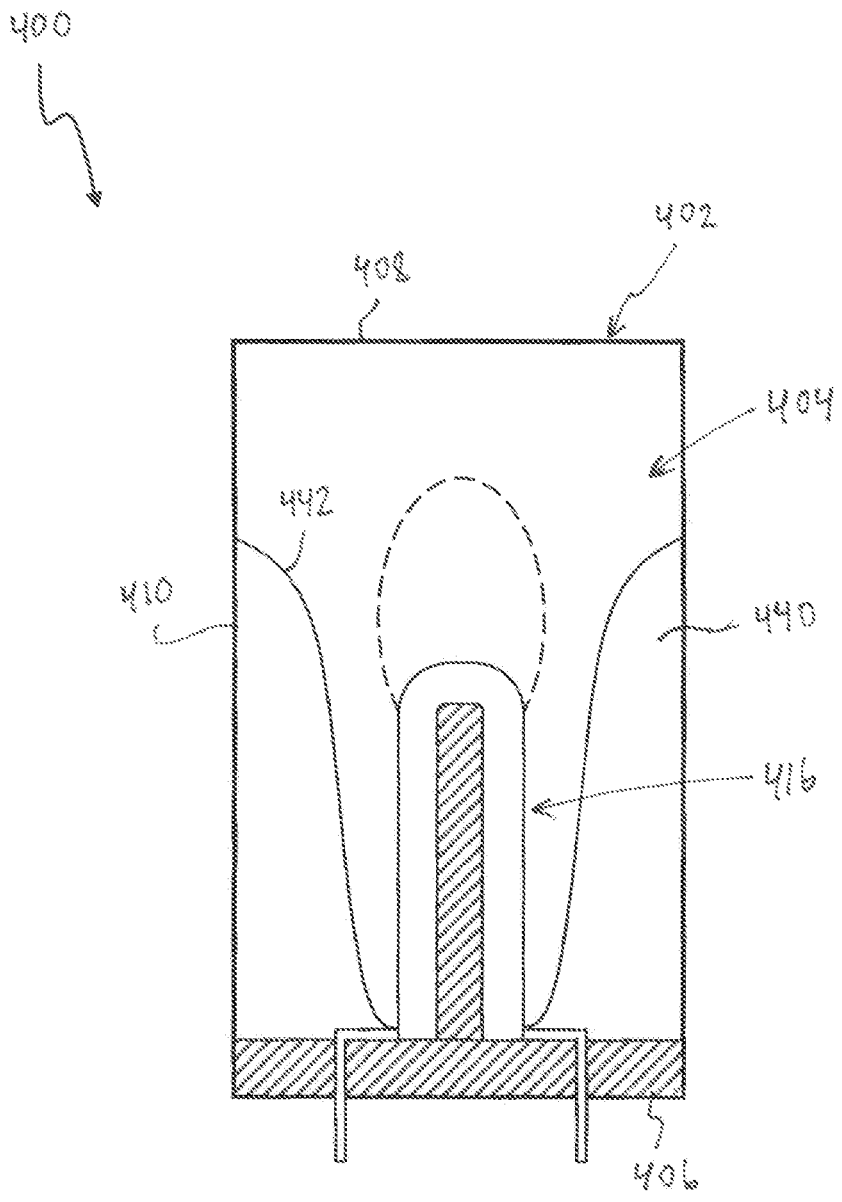
FIG. 4 is a side cross-sectional view illustrating a protection device according to exemplary embodiments.

Referring to FIG. 4, an exemplary embodiment of a fuse device (hereinafter, "device") 400 in accordance with the present disclosure is shown. The device 400 may be the same or similar in certain aspects to the devices 100, 200, and 300 described above. As such, only certain aspects of the device 400 may hereinafter be described for the sake of brevity. The exemplary device 400 may include a housing 402 defining an internal cavity 404. A u-shaped fuse element 416 may be disposed within the cavity 404. The housing 402 may include a base wall 406, a top wall 408, and a set of side walls 410.

The housing 402 may further include an armor layer 440 extending towards the fuse element 416. In some embodiments, the armor layer 440 may be formed along interior surfaces of the side walls 410 and the base wall 406. As shown, the armor layer 440 is not formed along the top wall 408. An interior surface 442 of the armor layer 440 may partially define the cavity 404. In some embodiments, the armor layer 440 may be a stainless steel. In some embodiments, the cavity 404 may be filled with an arc suppressant material, such as silica, or sand.

Figure 5:
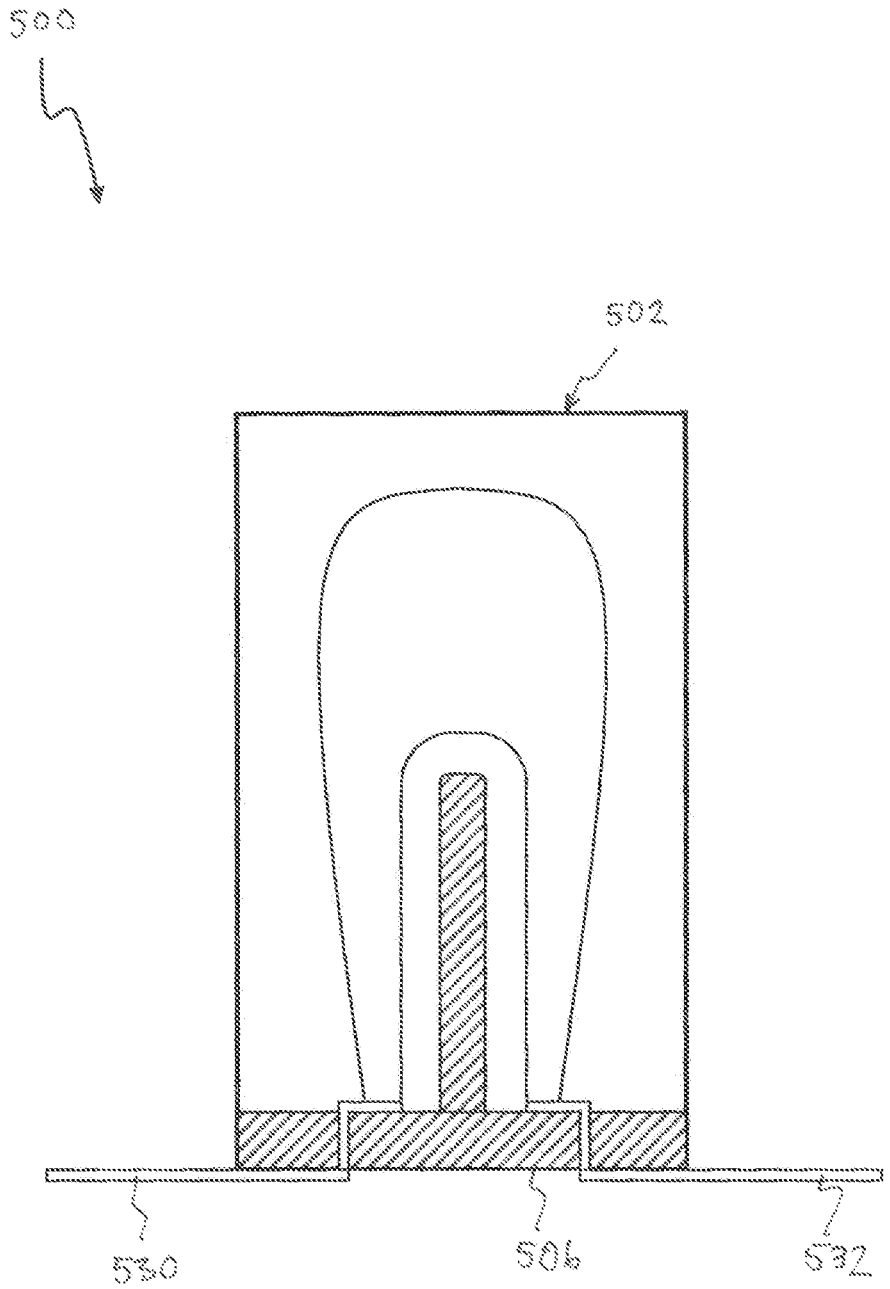
FIG. 5 is a side cross-sectional view illustrating a protection device according to exemplary embodiments.
Figure 6:
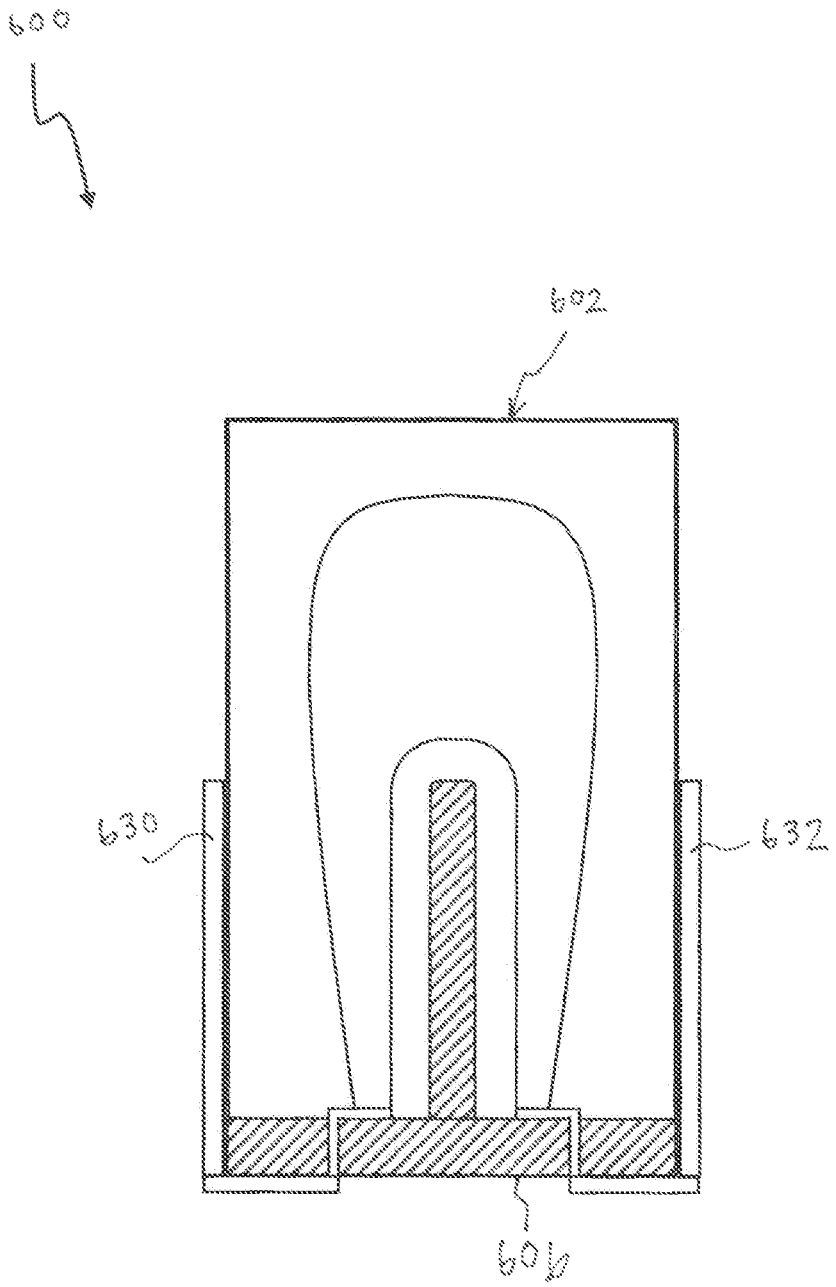
FIG. 6 is a side cross-sectional view illustrating a protection device according to exemplary embodiments.

It will be appreciated that various housing and terminal configurations may be possible in different embodiments. For example, as shown in device 500 of FIG. 5, a first terminal 530 and a second terminal 532 extend flat along a base wall 506 of a housing 502. In some embodiments, each of the first and second terminals 530, 532 may include openings (not shown) to receive a fastener. As shown in device 600 of FIG. 6, a first terminal 630 and a second terminal 632 extend along a base wall 606 and each sidewall 610 of a housing 602. The first and second terminals 530, 532 may be clampable.

The foregoing discussion has been presented for purposes of illustration and description and is not intended to limit the disclosure to the form or forms disclosed herein. For example, various features of the disclosure may be grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The use of "including," "comprising," or "having" and variations thereof herein is meant to encompass the items listed thereafter and equivalents thereof as well as additional items. Accordingly, the terms "including," "comprising," or "having" and variations thereof are open-ended expressions and can be used interchangeably herein.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other.

Furthermore, identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

Furthermore, the terms "substantial" or "substantially," as well as the terms "approximate" or "approximately," can be used interchangeably in some embodiments, and can be described using any relative measures acceptable by one of ordinary skill in the art. For example, these terms can serve as a comparison to a reference parameter, to indicate a deviation capable of providing the intended function. Although non-limiting, the deviation from the reference parameter can be, for example, in an amount of less than 1%, less than 3%, less than 5%, less than 10%, less than 15%, less than 20%, and so on.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, the present disclosure has been described herein in the context of a particular implementation in a particular environment for a particular purpose. Those of ordinary skill in the art will recognize the usefulness is not limited thereto and the present disclosure may be beneficially implemented in any number of environments for any number of purposes. Thus, the claims set forth below are to be construed in view of the full breadth and spirit of the present disclosure as described herein.

What is claimed is:

1. A protection device, comprising:

a housing defining a cavity;

a fuse element within the cavity, wherein the fuse element includes a first component and a second component separated by a barrier, and wherein the first and second components are joined at a bridge; and an armor layer formed along an interior surface of the housing, wherein the cavity has an inverted teardrop profile defined by an interior surface of the armor layer.

2. The protection device of claim 1, further comprising a first terminal connected to the first component and a second terminal connected to the second component, wherein the first and second terminals extend outside of the housing.

3. The protection device of claim 1, wherein the first and second components extend parallel to one another.

4. The protection device of claim 1, wherein the housing includes a base wall, wherein the barrier extends perpendicular to the base wall.

5. The protection device of claim 1, further comprising a plurality of splitter plates extending into the cavity from the housing.

6. The protection device of claim 1, further comprising an arc suppressant material within the cavity.

7. The protection device of claim 1, wherein the fuse element has an inverted U-shape.

8. A fuse assembly, comprising:

a housing defining a cavity, wherein the housing includes an armor layer extending into the cavity, and wherein the cavity has an inverted teardrop profile defined by an interior surface of the armor layer; and a fuse element within the cavity, wherein the fuse element includes a first component extending parallel to a second component, wherein the first and second components are joined at a bridge, and wherein the first and second components are separated by a barrier.

9. The fuse assembly of claim 8, further comprising a first terminal connected to the first component and a second terminal connected to the second component, wherein the first and second terminals extend outside of the housing.

10. The fuse assembly of claim 8, wherein the housing includes a base wall, wherein the barrier and the first and second components extend perpendicular to the base wall.

11. The fuse assembly of claim 8, further comprising a plurality of splitter plates extending into the cavity from a top wall of the housing.

12. The fuse assembly of claim 8, further comprising an arc suppressant material within the cavity.

13. The fuse assembly of claim 8, wherein the fuse element has an inverted U-shape.

14. A protection device, comprising:

a housing defining a cavity, wherein the housing includes an armor layer extending into the cavity, and wherein the cavity has an inverted teardrop profile defined by an interior surface of the armor layer; and a fuse element within the cavity, wherein the fuse element includes a first component and a second component separated by a barrier and joined at a fusible bridge, and wherein the fuse element has an inverted U-shape.

15. The protection device of claim 14, further comprising a first terminal connected to the first component and a second terminal connected to the second component, wherein the first and second terminals extend through a base wall of the housing.

16. The protection device of claim 14, further comprising a plurality of splitter plates extending into the cavity from a top wall of the housing.

* * * * *